US007281896B2

(12) United States Patent
Yu et al.

(10) Patent No.: US 7,281,896 B2
(45) Date of Patent: Oct. 16, 2007

(54) FAN AND IMPELLER THEREOF

(75) Inventors: Po-Hao Yu, Taoyuan Hsien (TW); Shun-Chen Chang, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/354,901

(22) Filed: Feb. 16, 2006

(65) Prior Publication Data

US 2006/0269412 A1 Nov. 30, 2006

(30) Foreign Application Priority Data

May 27, 2005 (TW) ..... 94117444 A

(51) Int. Cl.
*F03B 3/12* (2006.01)

(52) U.S. Cl. ..... 416/144; 416/500

(58) Field of Classification Search ..... 416/144, 416/145, 181, 231 R, 500; 415/106, 119; 417/353–354, 423.1
See application file for complete search history.

(56) References Cited

U.S. PATENT DOCUMENTS 1,105,807 A * 8/1914 Macneill ..... 416/106
2,193,826 A * 3/1940 Mann ..... 415/106
2,310,412 A * 2/1943 Flanders ..... 416/500
3,291,446 A * 12/1966 Huebner ..... 416/181
3,904,306 A * 9/1975 Navelsaker ..... 416/181
4,047,692 A * 9/1977 Swin, Sr. ..... 249/142
4,086,020 A * 4/1978 Tanabe et al. ..... 415/106
4,743,166 A * 5/1988 Elston et al. ..... 416/500
4,784,012 A * 11/1988 Marra ..... 416/144
5,547,365 A * 8/1996 Chuang ..... 425/577
7,063,507 B2 * 6/2006 Hsieh ..... 416/144

FOREIGN PATENT DOCUMENTS

GB 942648 A * 11/1963 ..... 416/231 R
JP 59-12101 A * 1/1984 ..... 415/119
SU 787731 A * 12/1980 ..... 416/106

* cited by examiner

*Primary Examiner*—Edward K. Look
*Assistant Examiner*—Dwayne J White
(74) *Attorney, Agent, or Firm*—Birch, Stewart, Kolasch & Birch, LLP

(57) ABSTRACT

An impeller includes a hub and at least one blade. In this case, the hub has at least one balancing portion disposed on hub and arranged with respect to a center of the hub. The balancing portion has at least one corner. The blades are disposed around the hub. In addition, a fan including the impeller is also provided. The impeller and the fan can enhance the rotation stability. As a result, the product reliability and lifetime can be increased. Furthermore, the impeller and the fan facilitate the balancing object to be separated from the tool at the corner.

20 Claims, 5 Drawing Sheets

FAN AND IMPELLER THEREOF

This non-provisional application claims priority under U.S.C. § 119(a) of patent application No. 094117444 filed in Taiwan, R.O.C. on May 27, 2005, the entire contents of which are hereby incorporated by reference.

BACKGROUND OF THE INVENTION

1. Field of Invention

The present invention relates to a fan and an impeller thereof and, in particular, to a fan and an impeller thereof with rotation stability.

2. Related Art

Fans are now in widespread use for heat dissipation, and are typically driven by motors so as to rotate and produce a pressure gradient, thereby generating a fluid flow. Consequently, it is an essential requirement for the fans to provide a good rotation balance.

Referring to FIGS. 1 and 2, a conventional fan includes an impeller 1 and a motor (not shown) for driving the impeller 1. The impeller 1 includes a hub 11 and at least one blade 12 disposed around the hub 11. In a practical manufacture, the impeller 1 is a one-piece molding by injection molding to form the blades 12 and the hub 11, with at least one straight type balancing portion 110. Conventionally, a tool is used to properly put the balancing object B, which is commonly selected from a high viscosity material such as epoxy or clay, into the straight type balancing portion 110 of the hub 11 according to the result of the oscillation test for the rotation of the impeller 1. The balance of the rotation of the fan is thereby adjusted. However, while using the tool to put the balancing object B into the balancing portion 110, the balancing object B is not easily separated from the tool due to high viscosity of the balancing object B. This is inconvenient to users.

As shown in FIG. 2, when the fan is rotating, centrifugal acceleration causes the balance object B to be easily spilled out from the edge of the opening of the straight type balancing portion 110. Accordingly, the appearance of the fan is unclean, and the rotation balance and reliability of the fan are destroyed.

Therefore, it is an important subject of the invention to provide a fan and an impeller thereof for avoiding the balance object B being spilled out, and to improve the rotation stability of the fan. As a result, reliability and lifetime of the fan can be increased.

SUMMARY OF THE INVENTION

In view of the foregoing, the present invention provides a fan and an impeller thereof for improving the rotation stability of the fan, so as to increase reliability and lifetime of the fan.

In addition, the present invention provides a fan and an impeller thereof for facilitating easy separation of the balancing object from the tool, so as to simplify the adjusting process.

To achieve the above, an impeller according to the present invention includes a hub, at least one blade and at least one balancing portion. The blade is disposed around the hub. The balancing portions are disposed on the hub and arranged with respect to a center of the hub. The balancing portion has at least one corner.

To achieve the above, a fan according to the present invention includes an impeller, at least one balancing portion and a motor. The impeller has a hub and at least one blade disposed around the hub. The hub has at least one balancing portion disposed on the hub and arranged with respect to a center of the hub. The balancing portion has at least one corner. The motor connects and drives the impeller to rotate.

As mentioned above, a fan and an impeller thereof according to the present invention has at least one corner disposed in the balancing portion. When the fan is rotating, the balancing object is constrained at the turning part so as to prevent the balancing object from being spilled. As a result, the appearance of the fan is clean and the rotation stability of the fan can be enhanced. Therefore, product reliability and lifetime of the fan can be increased. Furthermore, when users utilize a tool to put the balancing object into the balancing portion, the corner provides the function of a scraping effect, so as to facilitate easy separation of the balancing object from the tool at the corner.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

Figure 3:
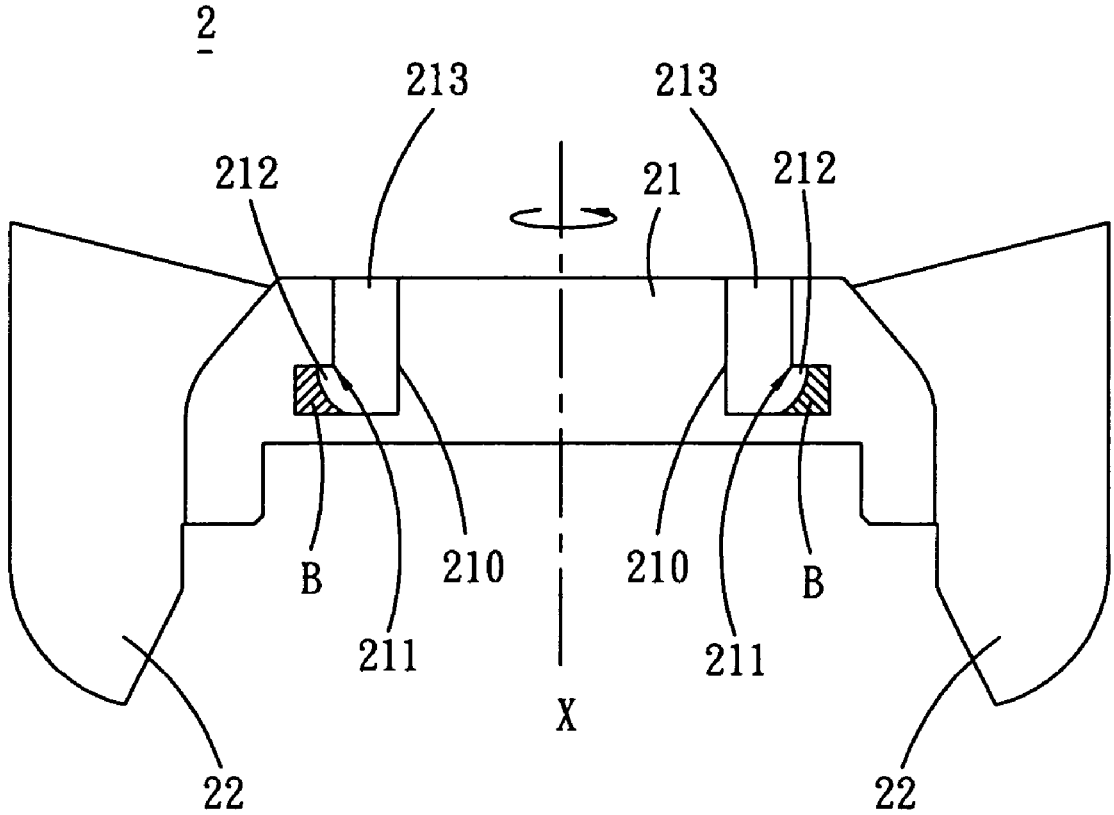
FIG. 3 is a cross-sectional view showing an impeller according to a first preferred embodiment of the present invention.

Referring to FIG. 3, an impeller 2 according to a first preferred embodiment of the present invention includes a hub 21 and at least one blade 22 disposed around the hub 21. The hub 21 has at least one balancing portion 210 disposed on the hub 21 and arranged with respect to a center X of the hub 21.

Figure 1:
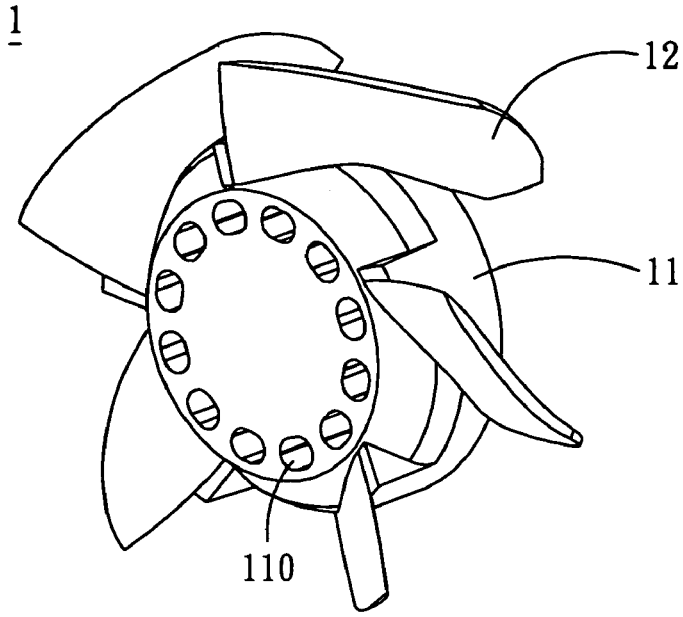
FIG. 1 (PRIOR ART)
FIG. 1 is a three-dimensional view showing a conventional impeller.
Figure 2:
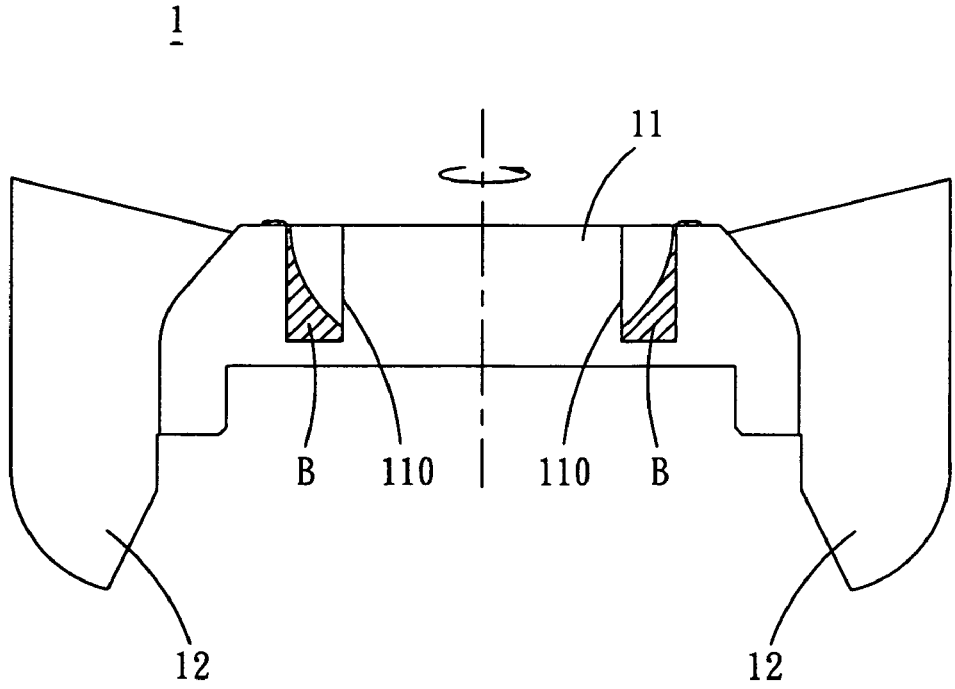
FIG. 2 (PRIOR ART)
FIG. 2 is a cross-sectional view showing the conventional impeller in FIG. 1.
Figure 4A:
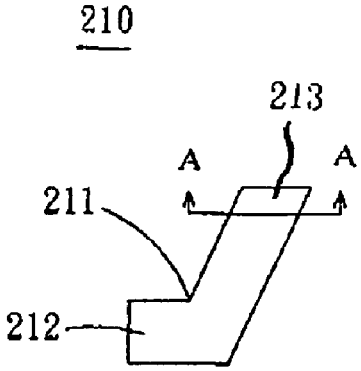
FIG. 4*a* to FIG. 4*f* are schematic views showing various configurations of the balancing portion in FIG. 3, and FIG. 4*f-a* to FIG. 4*f*-5 are cross-sectional views showing the opening part taken along a line A-A of FIG. 4*a;*
Figure 4B:
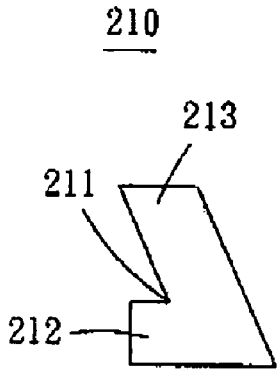
Figure 4C:
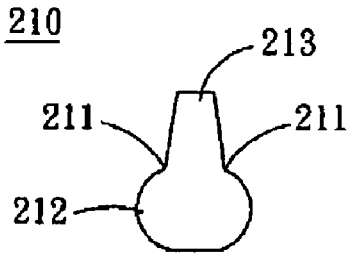
Figure 4D:
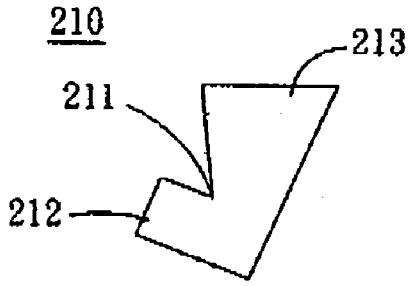
Figure 4E:
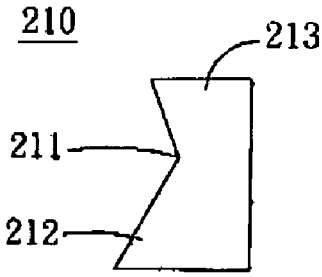
Figures 1, 4F:
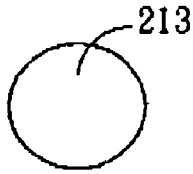
Figures 2, 4F:
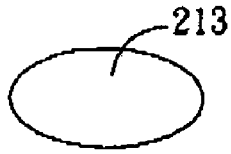
Figures 3, 4F:
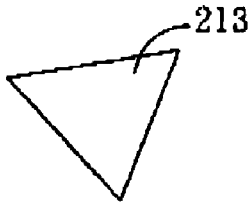

Each of the balancing portions 210 has at least one corner 211, a turning part 212 and an opening part 213. The corner 211 is located and connected between the opening part 213 and the turning part 212. A direction of the corner 211 is toward the radial direction of the center X of the hub 21. In this embodiment, the balancing portion 210 may have different configurations in accordance with the practical requirement. The opening part 213 may have a cross section with a circular (FIG. 4*f*-1), elliptical (FIG. 4*f*-2), triangular (FIG. 4*f*-3), rectangular (FIGS. 4*f*-4) or polygonal (FIG. 4*f*-5) shape, and a cross section of the turning part 212 may have a different shape and dimension, or the same shape and dimension, as the opening part 213.

When the impeller 2 is rotating, centrifugal force causes the balancing object B to move far away from the center X of the hub 21, so that the balancing object B can be constrained in the turning part 212 of the balancing portion 210. As a result, the balance object B can avoid being spilled out from the edge of the opening part 213.

Figures 4, 4F:
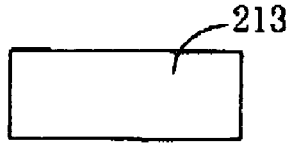

Referring to FIGS. 4(*a*) to 4(*e*), the opening part 213 may be a straight tunnel (as shown in FIGS. 4(*a*) to 4(*b*)), a tapered tunnel or a reverse tapered tunnel (as shown in FIGS. 4(*c*) to 4(*e*)) in this embodiment. An axial line of the opening part 213 is substantially parallel or not parallel to a shaft of the hub 21. In addition, the balancing portion 210 may have more than one corner so as to form a pot shape.

Figures 4, 4F, 5:
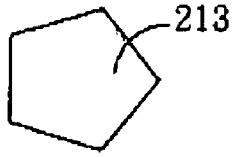
FIG. 5 is a three-dimensional view showing an impeller according to a second preferred embodiment of the present invention.
Figure 5:
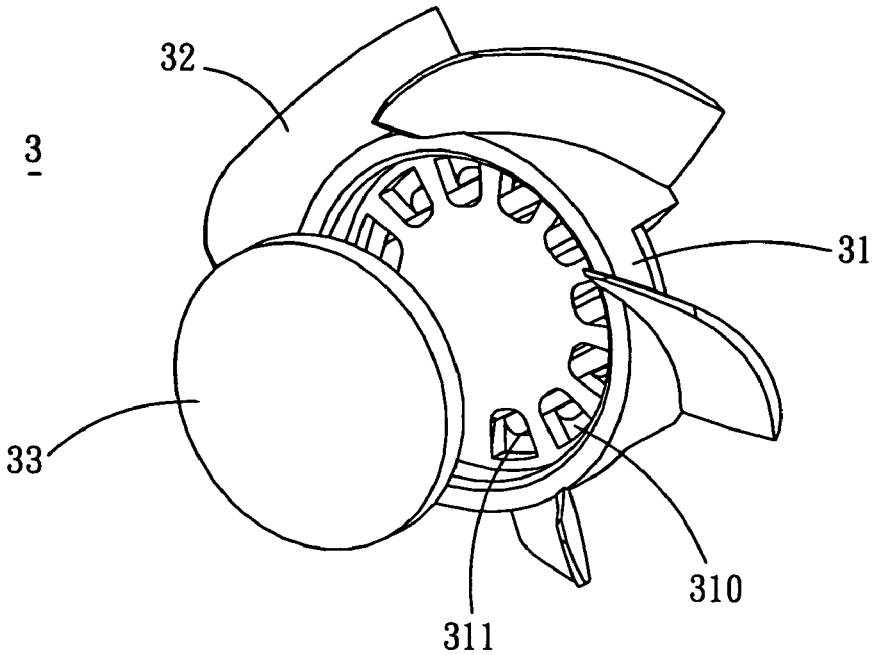
Figure 6:
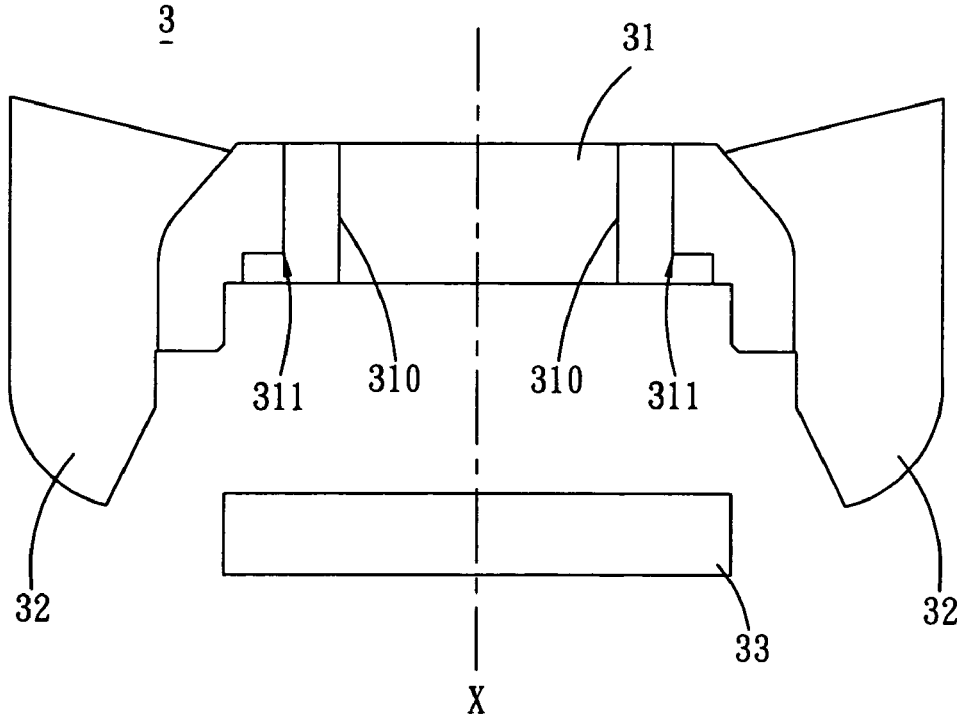
FIG. 6 is a cross-sectional view showing the impeller in FIG. 5.

Referring to FIGS. 5 and 6, an impeller 3, according to a second preferred embodiment of the present invention, includes a hub 31 and at least one blade 32 disposed around the hub 31. The hub 31 has at least one balancing portion 310 disposed on the hub 31 and arranged with respect to a center X of the hub 31. Particularly, each of the at least one balancing portions 310 penetrates through the hub 31 and has at least one corner 311.

In this embodiment, the impeller 3 further includes a block element 33 connected to the hub 31 for closing one end of the balancing portion 310. According to the practical requirement, the block element 33 may have different configurations such as a circular plate or an annular plate. In addition, a casing of the motor may be directly connected to the hub 31 for closing one end of the balancing portion 310.

The balancing portion 310 has the same construction and function as that in the first preferred embodiment. In addition, the balancing portion 310 may also be disposed independently. The corresponding descriptions are omitted for conciseness.

The impeller herein above may be connected to and driven by a motor so that various fans are provided.

Figure 7:
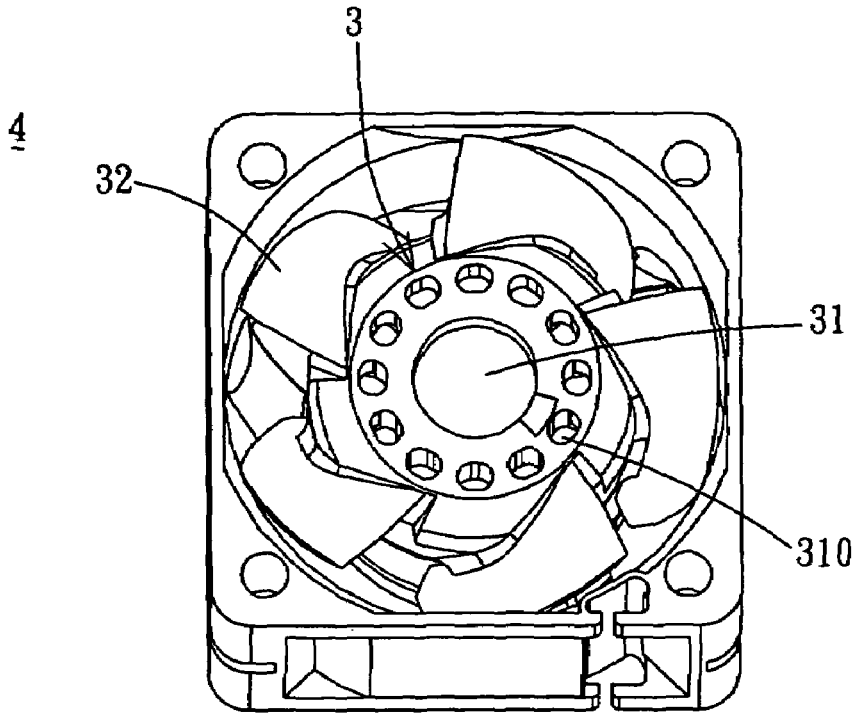
FIG. 7 is a three-dimensional view showing a fan according to a preferred embodiment of the present invention.
Figure 8:
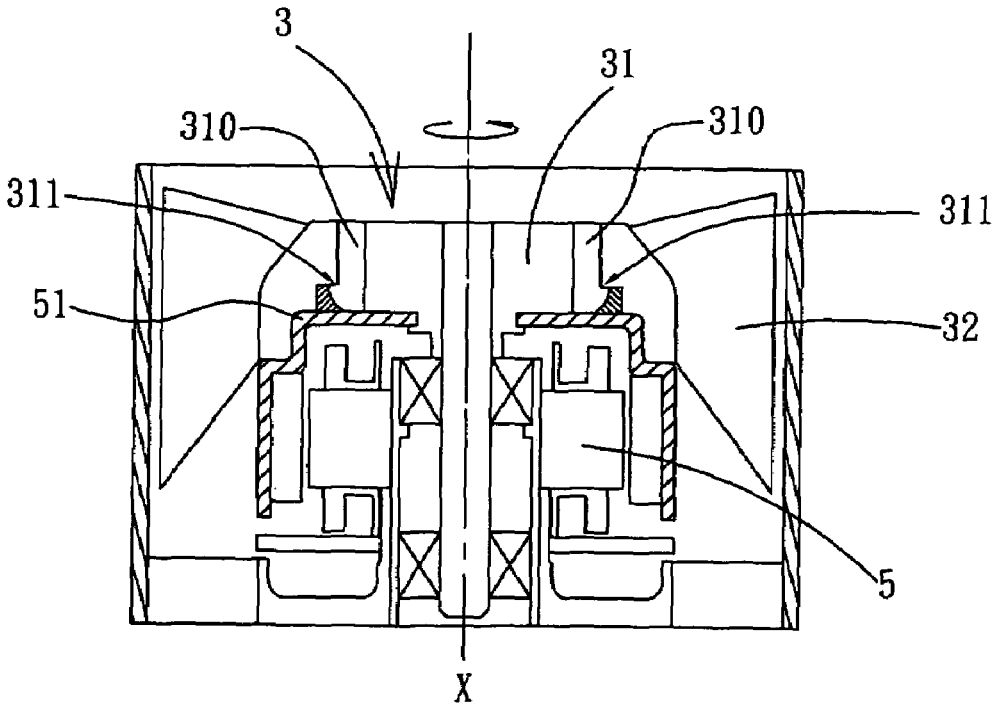
FIG. 8 is a cross-sectional view showing the fan in FIG. 7.

Referring to FIGS. 7 and 8, according to a preferred embodiment of the present invention, a fan 4 includes an impeller 3 and a motor 5. The impeller 3 includes a hub 31 and at least one blade 32 disposed around the hub 31. The hub 31 has at least one balancing portion 310 disposed on the hub 31 and arranged with respect to a center X of the hub 31. Also, each of the balancing portions 310 penetrates through the hub 31 and has at least one corner 311. The motor 5 connects and drives the impeller 3 to rotate, and the motor 5 has a casing 51 directly connected to the hub 31 for closing one end of the balancing portion 310.

In summary, according to the present invention, a fan and an impeller thereof have at least one corner disposed in the balancing portion. When the fan is rotating, the balancing object is constrained at the turning part, so as to prevent the balancing object from being spilled. As a result, the appearance of the fan is clean and the rotation stability of the fan can be enhanced. Therefore, product reliability and lifetime of the fan can be increased. Furthermore, when users utilize a tool to put the balancing object into the balancing portion, the corner provides the function of a scraping effect in order to facilitate easy separation of the balancing object from the tool at the corner.

Although the present invention has been described with reference to specific embodiments, it is to be understood that the present invention is not limited to the disclosed embodiments. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. An impeller, comprising:

a hub;

at least one blade, disposed around the hub; and at least one balancing portion disposed on the hub for accommodating a balancing object and having at least one corner, wherein the at least one balancing portion comprises an opening part and a turning part, and the at least one corner is located and connected between the opening part and the turning part, so that the balancing object is constrained at the turning part.

2. The impeller according to claim 1, wherein the opening part has a cross section with a circular, elliptic, triangular, rectangular or polygonal shape, and the opening part is a straight tunnel, a tapered tunnel or a reverse tapered tunnel.

3. The impeller according to claim 1, wherein a cross section of the turning part has a different shape and dimension from that of the opening part.

4. The impeller according to claim 1, wherein an axial line of the opening part is substantially parallel or not parallel to a shaft of the hub.

5. The impeller according to claim 1, wherein the at least one balancing portion is disposed on the hub and arranged with respect to a center of the hub.

6. The impeller according to claim 5, wherein the at least one balancing portion penetrates through the hub.

7. The impeller according to claim 6, further comprising:

a block element, connected to the hub for closing one end of the at least one balancing portion.

8. The impeller according to claim 7, wherein the block element is a circular plate or an annular plate.

9. The impeller according to claim 1, wherein a direction of the at least one corner is toward a radial direction of the hub.

10. The impeller according to claim 1, wherein the at least one balancing portion is pot-shaped.

11. A fan, comprising:

an impeller comprising a hub and at least one blade disposed around the hub;

at least one balancing portion disposed on the hub for accommodating a balancing object and having at least one corner;

a motor for driving the impeller to rotate; and a block element, connected to the hub for closing one end of the at least one balancing portion.

12. The fan according to claim 11, wherein the at least one balancing portion comprises an opening part and a turning part, the at least one corner is located at and connected between the opening part and the turning part, the opening part has a cross section with a circular, elliptic, triangular, rectangular or polygonal shape, and the opening part is a straight tunnel, a tapered tunnel or a reverse tapered tunnel.

13. The fan according to claim 11, wherein the at least one balancing portion comprises an opening part and a turning part, the at least one corner is located at and connected between the opening part and the turning part, and a cross section of the turning part has a different shape and dimension from that of the opening part.

14. The fan according to claim 11, wherein the at least one balancing portion comprises an opening part and a turning part, the at least one corner is located at and connected between the opening part and the turning part, and an axial line of the opening part is substantially parallel or not parallel to a shaft of the hub.

15. The fan according to claim 11, wherein the at least one balancing portion is disposed on the hub and arranged with respect to the hub.

16. The fan according to claim 15, wherein the at least one balancing portion penetrates through the hub.

17. The fan according to claim 16, wherein the motor closes one end of the at least one balancing portion.

18. The fan according to claim 11, wherein a direction of the at least one corner is toward a radial direction of the hub.

19. An impeller, comprising:

a hub;

at least one blade, disposed around the hub;

at least one balancing portion disposed on the hub for accommodating a balancing object and having at least one corner; and a block element, connected to the hub for closing one end of the at least one balancing portion.

20. The impeller according to claim 19, wherein the block element is a circular plate or an annular plate.

* * * * *